US012753962B2

(12) United States Patent
Mohammad et al.

(10) Patent No.: US 12,753,962 B2
(45) Date of Patent: Oct. 6, 2026

(54) ICE MAKER APPLIANCE WITH AUTOMATIC SHUT OFF FEATURES

(71) Applicant: Haier US Appliance Solutions, Inc., Wilmington, DE (US)

(72) Inventors: Zakriya Mohammad, Louisville, KY (US); Wentao Zhuo, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 142 days.

(21) Appl. No.: 18/326,640

(22) Filed: May 31, 2023

(65) Prior Publication Data

US 2024/0401861 A1 Dec. 5, 2024

(51) Int. Cl.
*F25C 1/04* (2018.01)

(52) U.S. Cl.
CPC ..... *F25C 1/04* (2013.01); *F25C 2600/00* (2013.01); *F25C 2700/02* (2013.01)

(58) Field of Classification Search
CPC .... F25C 1/04; F25C 2600/00; F25C 2700/02; F25C 5/187; F25C 5/06; F25C 5/22; F25C 2600/04; F25C 2700/04; F25C 2700/12; F25D 2700/02
USPC ..... 62/66
See application file for complete search history.

(56) References Cited

U.S. PATENT DOCUMENTS 3,675,437 A * 7/1972 Linstromberg ..... F25C 1/24 62/155
3,803,862 A * 4/1974 Schumacher ..... F25C 1/04 62/526
3,855,812 A * 12/1974 Linstromberg ..... F25C 1/04 62/135
4,424,683 A * 1/1984 Manson ..... F25C 1/04 62/135
4,852,359 A * 8/1989 Manzotti ..... F25C 1/10 62/353
4,872,318 A * 10/1989 Klemmensen ..... F25C 1/04 62/344
4,947,653 A * 8/1990 Day ..... F25C 5/10 62/73
5,042,263 A * 8/1991 Day ..... F25C 5/10 62/74

(Continued)

FOREIGN PATENT DOCUMENTS

CA 2642433 A1 * 6/2009 ..... F25C 5/043
EP 0683365 A1 * 11/1995 ..... F25C 1/12

(Continued)

OTHER PUBLICATIONS

JP-2022046106-A, machine translation (Year: 2025).*

*Primary Examiner* — Eric S Ruppert
*Assistant Examiner* — Kirstin U Oswald
(74) *Attorney, Agent, or Firm* — Dority & Manning, P.A.

(57) ABSTRACT

A method for operating an ice maker appliance includes operating a harvest mechanism of an ice maker assembly to perform a harvest cycle. An amount of ice may be harvested from the ice maker appliance due to the harvest cycle. The method further includes determining the amount of ice harvested is less than a predetermined threshold. The method also includes suspending operation of the harvest mechanism based on the amount of ice harvested less than the predetermined threshold.

16 Claims, 11 Drawing Sheets

(56) References Cited

U.S. PATENT DOCUMENTS 5,129,237 A * 7/1992 Day ..... F25C 1/12 62/73
5,619,858 A * 4/1997 Gunderson ..... F25C 5/187 62/344
5,829,257 A * 11/1998 Newman ..... F25C 5/10 62/73
6,133,555 A * 10/2000 Brenn ..... F25D 29/00 219/494
8,857,198 B2 * 10/2014 Styn ..... F25C 5/22 62/126
2003/0010055 A1 * 1/2003 Kuroyanagi ..... F25C 1/147 62/139
2006/0086107 A1 * 4/2006 Voglewede ..... F25C 1/246 62/157
2006/0086134 A1 * 4/2006 Voglewede ..... F25C 5/06 62/353
2006/0086135 A1 * 4/2006 Wu ..... F25D 23/12 62/351
2006/0201170 A1 * 9/2006 Cole ..... F25C 1/04 62/340
2006/0207282 A1 * 9/2006 Visin ..... F25D 23/12 62/351
2006/0242971 A1 * 11/2006 Cole ..... F25C 1/04 62/340
2007/0089450 A1 * 4/2007 Janardhanam ..... F25D 23/126 62/340
2007/0093936 A1 * 4/2007 Johnson ..... F25D 23/126 700/240
2007/0186570 A1 * 8/2007 Kopf ..... F25D 21/08 62/344
2008/0072610 A1 * 3/2008 Venkatakrishnan ..... F25C 1/04 62/135
2010/0161137 A1 6/2010 Kim et al.
2010/0218542 A1 * 9/2010 McCollough ..... F25D 11/022 700/275
2012/0186288 A1 * 7/2012 Hapke ..... F25C 5/187 62/137
2013/0327069 A1 * 12/2013 Styn ..... F25C 5/22 62/126
2014/0190188 A1 * 7/2014 Li ..... F25C 5/22 62/130
2014/0196478 A1 * 7/2014 Severance ..... F25C 5/02 62/340
2014/0208781 A1 * 7/2014 Broadbent ..... F25C 5/185 62/66
2016/0116198 A1 * 4/2016 Becker ..... F25C 5/06 62/344
2016/0201980 A1 * 7/2016 Kang ..... F25C 1/24 62/158
2017/0370628 A1 * 12/2017 Knatt ..... F25C 1/25
2018/0142934 A1 * 5/2018 Junge ..... F25D 17/065
2021/0302091 A1 * 9/2021 Olvera ..... F25C 1/04
2022/0397440 A1 * 12/2022 Broadbent ..... G05D 9/12

FOREIGN PATENT DOCUMENTS

EP 1522805 A1 * 4/2005 ..... F25C 1/20
EP 1522806 A1 * 4/2005 ..... F25C 1/04
EP 2064499 B1 * 7/2013 ..... G01F 3/00
GB 2327774 A * 2/1999 ..... G05B 19/0428
JP 2022046106 A * 3/2022
KR 20220114430 A * 8/2022 ..... F25C 1/24
WO WO-2017039978 A1 * 3/2017 ..... F25C 1/22
WO WO-2022237725 A1 * 11/2022 ..... F25C 1/24

* cited by examiner

ICE MAKER APPLIANCE WITH AUTOMATIC SHUT OFF FEATURES

FIELD

The present subject matter relates generally to ice maker appliances, and more particularly to methods of operating ice maker appliances.

BACKGROUND

Certain appliances, such as a stand-alone ice maker appliances or refrigerator appliances, may include an ice maker that may be configured to produce ice. To produce ice, liquid water is directed to the ice maker and frozen. For example, certain ice makers include a mold body for receiving liquid water. After the mold body is filled with liquid water, the mold body and liquid water therein are cooled to freeze the liquid water and thereby form ice. After ice is formed in the mold body, it may be harvested from the mold body and stored within an ice bin or bucket within the ice maker appliance.

In some instances, a water supply may not be properly connected to the ice maker appliance and liquid water may not be flowing to the mold body. In additional instances, the flow of liquid water may not successfully reach the mold body due to a variety of complications, for example, the liquid water may freeze within a fill tube of the ice maker appliance. Such complications may result in ice not forming within the mold body as there is no liquid water flowing to the ice maker. In such instances, harvest cycles may continue to be performed despite a lack of ice forming within the ice maker appliance. These harvest cycles that do not harvest any ice may waste a significant amount of energy.

Accordingly, an ice maker appliance with features for automatically suspending operation of a harvest mechanism of the ice maker appliance when it is determined that there is an absence of liquid water to the ice maker appliance would be beneficial.

BRIEF DESCRIPTION

Aspects and advantages of the invention will be set forth in part in the following description, or may be apparent from the description, or may be learned through practice of the invention.

In one exemplary embodiment, a method for operating an ice maker appliance is provided. The method may include a step of operating a harvest mechanism of an ice maker assembly to perform a harvest cycle, whereby an amount of ice is harvested from the ice maker appliance. The method may also include a step of determining the amount of ice harvested is less than a predetermined threshold. The method may further include a step of suspending operation of the harvest mechanism based on the amount of ice harvested less than the predetermined threshold.

In another exemplary embodiment, an ice maker appliance is provided. The ice maker appliance may include an ice maker assembly that includes a harvest mechanism. The ice maker appliance may also include a controller operably coupled to the ice maker assembly. The controller may be operable for: operating a harvest mechanism of an ice maker assembly to perform a harvest cycle, whereby an amount of ice is harvested from the ice maker appliance; determining the amount of ice harvested is less than a predetermined threshold; suspending operation of the harvest mechanism based on the amount of ice harvested less than the predetermined threshold.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

Figure 1:
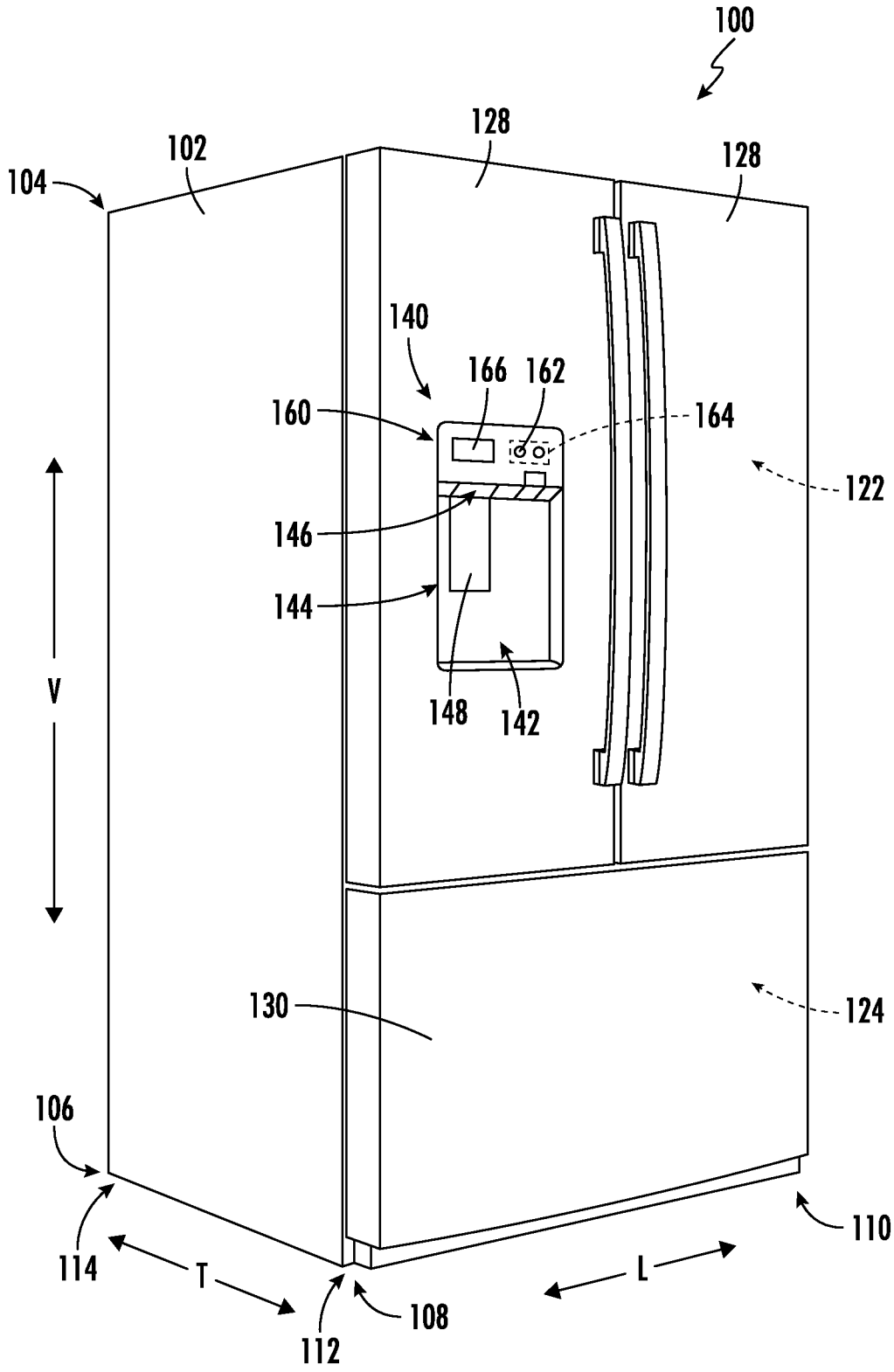
FIG. 1 provides a perspective view of a refrigerator appliance according to an exemplary embodiment of the present subject matter.

Repeat use of reference characters in the present specification and drawings is intended to represent the same or analogous features or elements of the present invention.

DETAILED DESCRIPTION

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the terms "first," "second," and "third" may be used interchangeably to distinguish one component from another and are not intended to signify location or importance of the individual components. The terms "includes" and "including" are intended to be inclusive in a manner similar to the term "comprising." Similarly, the term "or" is generally intended to be inclusive (i.e., "A or B" is intended to mean "A or B or both"). In addition, here and throughout the specification and claims, range limitations may be combined and/or interchanged. Such ranges are identified and include all the sub-ranges contained therein unless context or language indicates otherwise. For example, all ranges disclosed herein are inclusive of the endpoints, and the endpoints are independently combinable with each other. The singular forms "a," "an," and "the" include plural references unless the context clearly dictates otherwise.

Approximating language, as used herein throughout the specification and claims, may be applied to modify any quantitative representation that could permissibly vary without resulting in a change in the basic function to which it is related. Accordingly, a value modified by a term or terms, such as "generally," "about," "approximately," and "substantially," are not to be limited to the precise value specified. In at least some instances, the approximating language may correspond to the precision of an instrument for measuring the value, or the precision of the methods or machines for constructing or manufacturing the components and/or systems. For example, the approximating language may refer to being within a ten percent margin, i.e., including values within ten percent greater or less than the stated value. In this regard, for example, when used in the context of an angle or direction, such terms include within ten degrees greater or less than the stated angle or direction, e.g., "generally vertical" includes forming an angle of up to ten degrees in any direction, e.g., clockwise, or counterclockwise, with the vertical direction V.

The word "exemplary" is used herein to mean "serving as an example, instance, or illustration." In addition, references to "an embodiment" or "one embodiment" does not necessarily refer to the same embodiment, although it may. Any implementation described herein as "exemplary" or "an embodiment" is not necessarily to be construed as preferred or advantageous over other implementations. Moreover, each example is provided by way of explanation of the invention, not limitation of the invention. In fact, it will be apparent to those skilled in the art that various modifications and variations can be made in the present invention without departing from the scope of the invention. For instance, features illustrated or described as part of one embodiment can be used with another embodiment to yield a still further embodiment. Thus, it is intended that the present invention covers such modifications and variations as come within the scope of the appended claims and their equivalents.

The present disclosure generally pertains to ice maker appliances of various forms. For example, the ice maker appliance may be incorporated into a refrigerator appliance, e.g., as described below in respect to certain exemplary embodiments. In additional embodiments, an ice maker appliance according to the present disclosure may be a stand-alone ice maker appliance, or may be a refrigerator appliance having a different configuration than the illustrated exemplary embodiments, such as a side-by-side refrigerator appliance, a fresh food only (single chamber) appliance, or a single chamber, freezer only, appliance, among other possible examples of an ice maker appliance.

Figure 2:
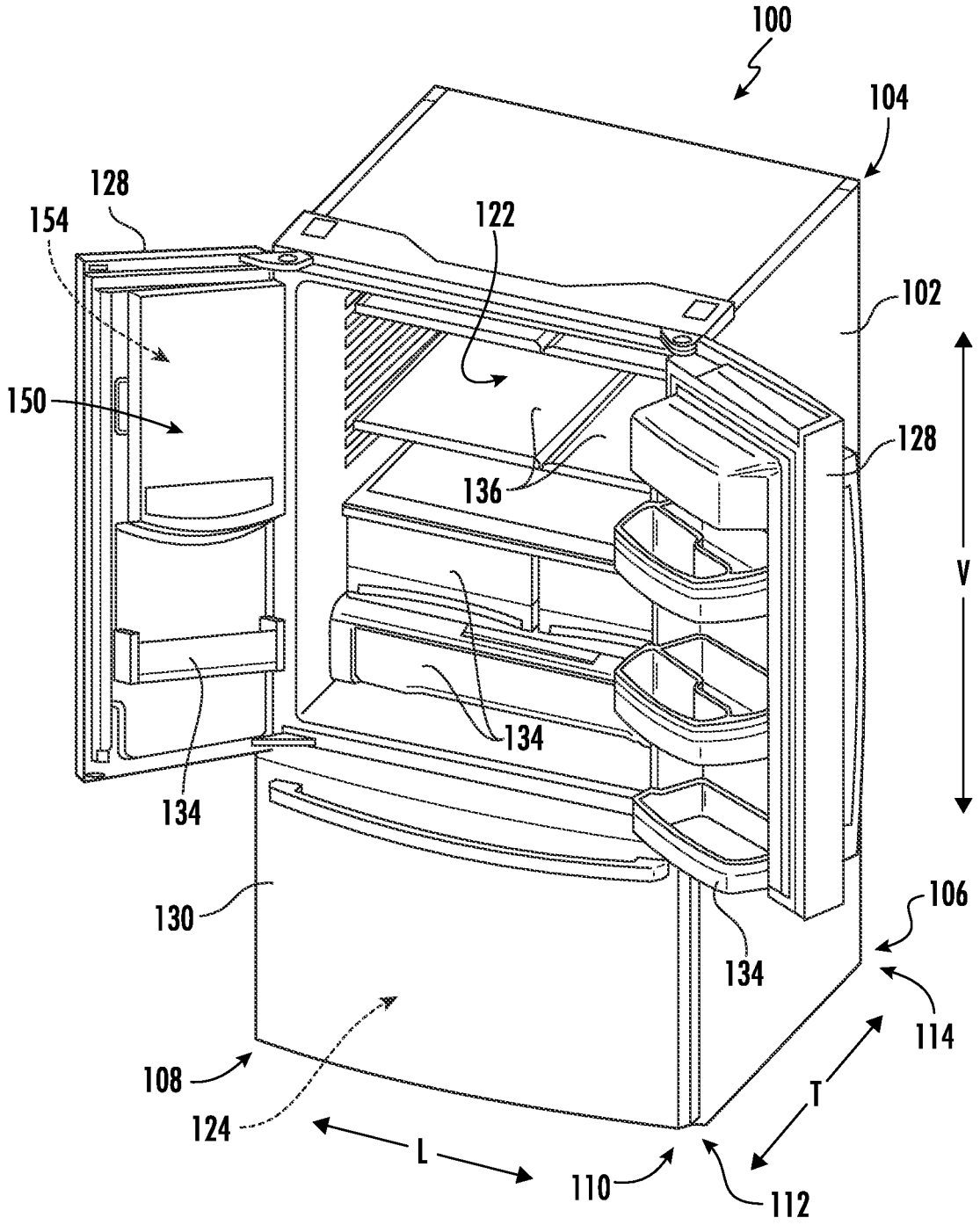
FIG. 2 provides a perspective view of the exemplary refrigerator appliance of FIG. 1, with the doors of the fresh food chamber shown in an open position.

Referring now to the figures, FIGS. 1 and 2 provide perspective views of a refrigerator appliance 100 according to an exemplary embodiment of the present disclosure. Refrigerator appliance 100 includes a cabinet or housing 102 that extends between a top 104 and a bottom 106 approximately along a vertical direction V, between a first side 108 and a second side 110 approximately along a lateral direction L, and between a front side 112 and a rear side 114 approximately along a transverse direction T. Each of the vertical direction V, lateral direction L, and transverse direction T are mutually perpendicular to one another.

Housing 102 defines one or more chilled chambers for receipt of food items for storage. In particular, housing 102 defines fresh food chamber 122 positioned at or adjacent top 104 of housing 102 and a freezer chamber 124 arranged at or adjacent bottom 106 of housing 102. As such, refrigerator appliance 100 is generally referred to as a bottom mount refrigerator. It is recognized, however, that the benefits of the present disclosure apply to other types and styles of refrigerator appliances, for example, a top mount refrigerator appliance, a side-by-side style refrigerator appliance, or a single door refrigerator appliance. Consequently, the description set forth herein is for illustrative purposes only and is not intended to be limiting in any aspect to any particular refrigerator chamber configuration.

Refrigerator doors 128 are rotatably hinged to an edge of housing 102 for selectively accessing fresh food chamber 122. In addition, a freezer door 130 is arranged below refrigerator doors 128 for selectively accessing freezer chamber 124. Freezer door 130 is coupled to a freezer drawer (not shown) slidably mounted within freezer chamber 124. Refrigerator doors 128 and freezer door 130 are shown in the closed configuration in FIG. 1. One skilled in the art will appreciate that other chamber and door configurations are possible and within the scope of the present invention.

FIG. 2 provides a perspective view of refrigerator appliance 100 shown with refrigerator doors 128 in the open position. As shown in FIG. 2, various storage components are mounted within fresh food chamber 122 to facilitate storage of food items therein as will be understood by those skilled in the art. In particular, the storage components may include bins 134 and shelves 136. Each of these storage components are configured for receipt of food items (e.g., beverages and/or solid food items, etc.) and may assist with organizing such food items. As illustrated, for instance, in FIG. 2, bins 134 may be mounted on refrigerator doors 128 or may slide into a receiving space in fresh food chamber 122. It should be appreciated that the illustrated storage components are used only for the purpose of explanation and that other storage components may be used and may have different sizes, shapes, and configurations.

Referring now generally to FIG. 1, a dispensing assembly 140 will be described according to exemplary embodiments of the present subject matter. Dispensing assembly 140 is generally configured for dispensing liquid water, ice, or a combination thereof. Although an exemplary dispensing assembly 140 is illustrated and described herein, it should be appreciated that variations and modifications may be made to dispensing assembly 140 while remaining within the present subject matter.

Dispensing assembly 140 and its various components may be positioned at least in part within a dispenser recess 142 defined on one of refrigerator doors 128. In this regard, dispenser recess 142 is defined on a front side 112 of refrigerator appliance 100 such that a user may operate dispensing assembly 140 without opening refrigerator door 128. In addition, dispenser recess 142 is positioned at a predetermined elevation convenient for a user to access liquid water, ice, or a combination thereof and enabling the user to access liquid water, ice, or a combination thereof without the need to bend over. In the exemplary embodiment, dispenser recess 142 is positioned at a level that approximates the chest level of a user.

Dispensing assembly 140 includes a dispenser 144 including a discharging outlet 146 for discharging liquid water, ice, or a combination thereof from dispensing assembly 140. An actuating mechanism 148, shown as a paddle, is mounted below discharging outlet 146 for dispenser 144. In alternative exemplary embodiments, any suitable actuating mechanism may be used to operate dispenser 144. For example, dispenser 144 can include a sensor (such as an ultrasonic sensor) or a button rather than the paddle. Discharging outlet 146 and actuating mechanism 148 are an external part of dispenser 144 and are mounted in dispenser recess 142.

A control panel 160 is provided for controlling the mode of operation. For example, control panel 160 includes one or more selector inputs 162, such as knobs, buttons, touch-screen interfaces, etc., such as a water dispensing button and an ice-dispensing button, for selecting a desired mode of operation such as crushed or non-crushed ice. In addition, the selector inputs 162 may be used to specify a fill volume or method of operating dispensing assembly 140. In this regard, selector inputs 162 may be in communication with a processing device or controller 164. Signals generated in controller 164 operate refrigerator appliance 100 and dispensing assembly 140 in response to selector inputs 162. Additionally, a display 166, such as an indicator light or a screen, may be provided on control panel 160. Display 166 may be in communication with controller 164 and may display information in response to signals from controller 164.

As used herein, "processing device" or "controller" may refer to one or more microprocessors or semiconductor devices and is not restricted necessarily to a single element. The processing device can be programmed to operate an ice maker appliance, such as the refrigerator appliance 100 and the ice maker assembly and dispensing assembly 140 thereof. The processing device may include, or be associated with, one or more memory elements (e.g., non-transitory storage media). In some such embodiments, the memory elements include electrically erasable, programmable read only memory (EEPROM). Generally, the memory elements can store information accessible to the processing device, including instructions that can be executed by processing device. Optionally, the instructions can be software or any set of instructions and/or data that when executed by the processing device, cause the processing device to perform operations.

Figure 3:
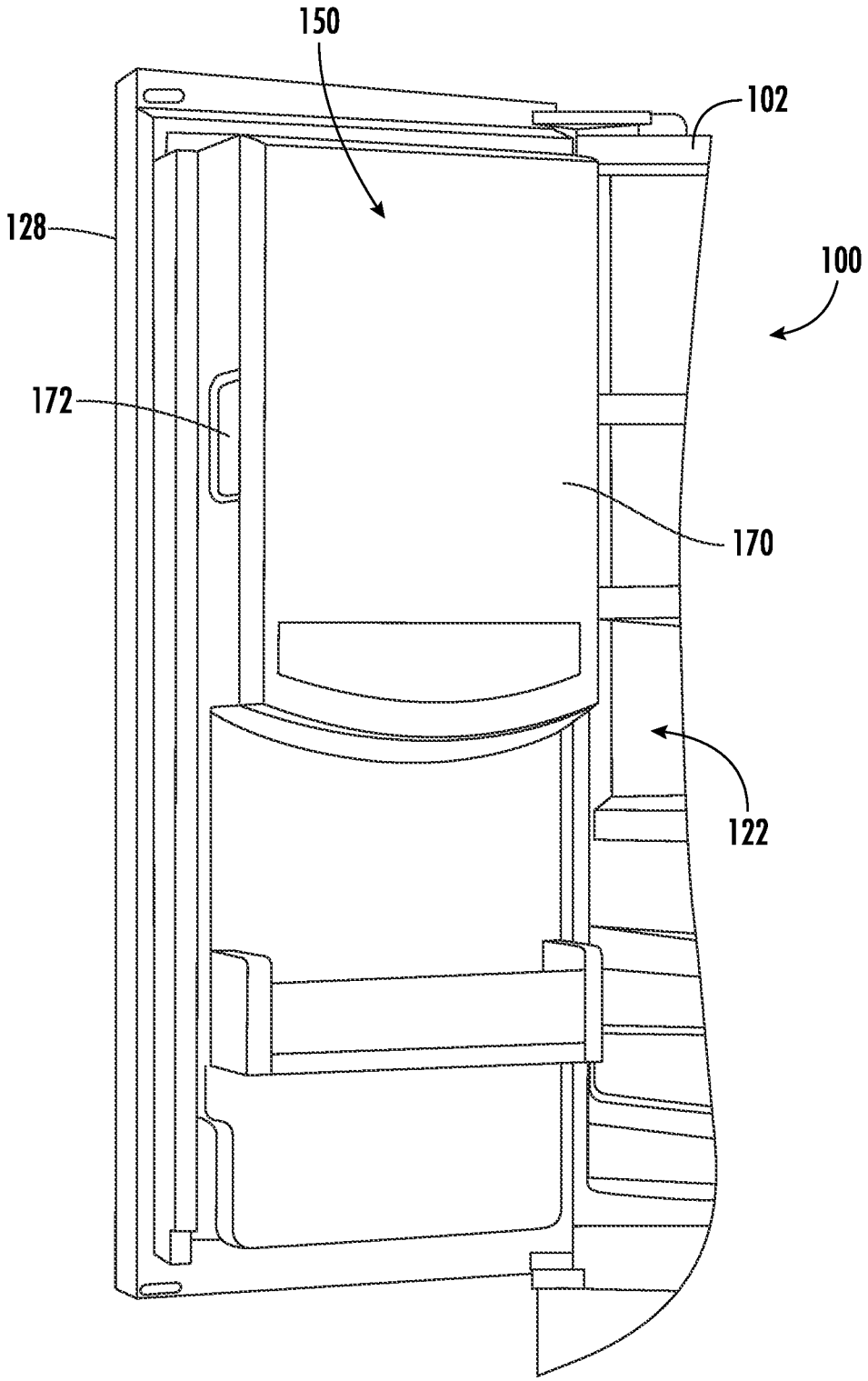
FIG. 3 provides an interior perspective view of a dispenser door of the exemplary refrigerator appliance of FIG. 1.
Figure 4:
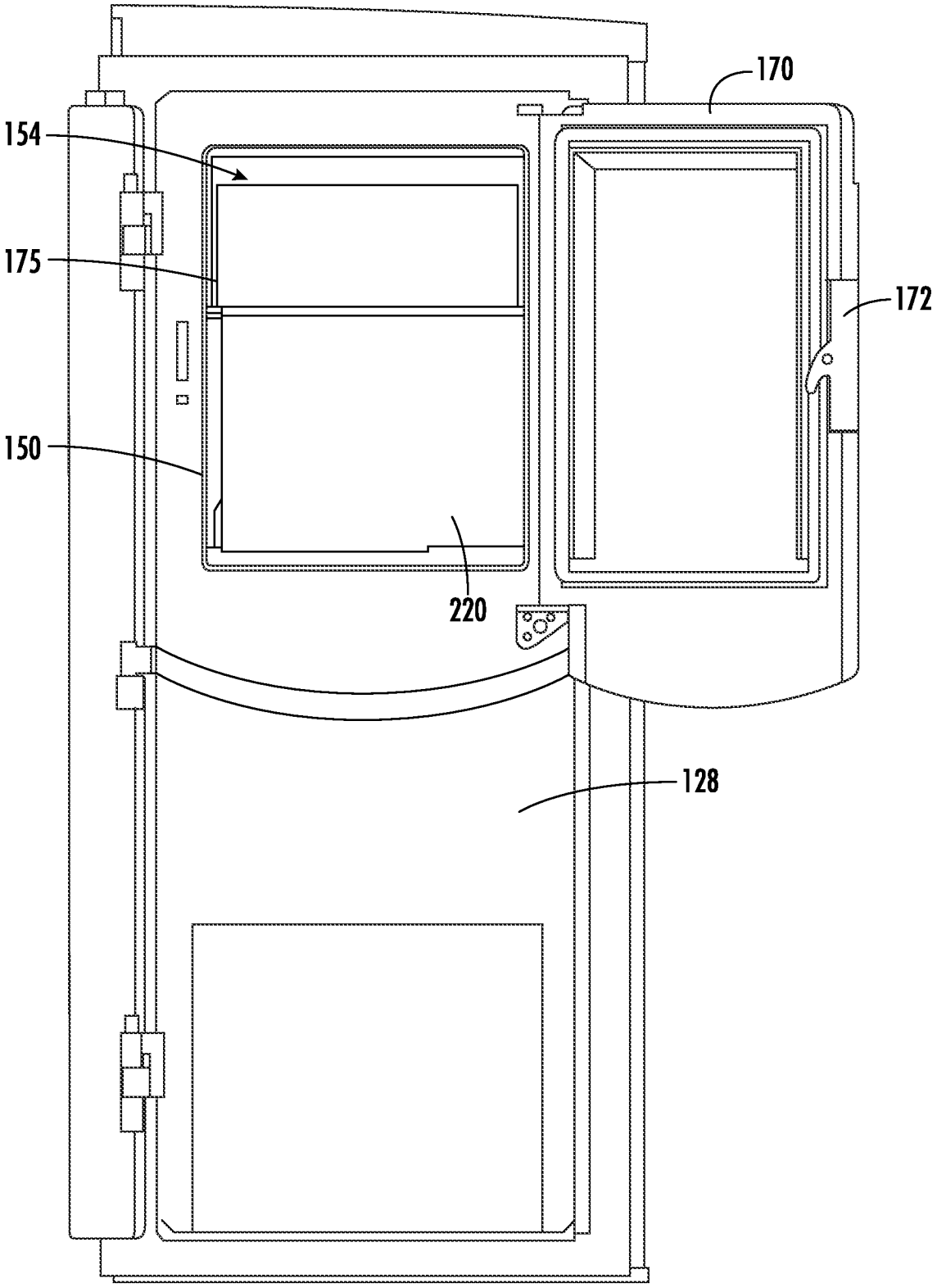
FIG. 4 provides an interior elevation view of the dispenser door of FIG. 3 with an access door of the dispenser door shown in an open position.

Referring now to FIGS. 3 and 4, FIG. 3 provides an interior perspective view of one of the refrigerator doors 128 and FIG. 4 provides an interior elevation view of the door 128 with an access door 170 shown in an open position. Refrigerator appliance 100 includes a sub-compartment 150 defined on refrigerator door 128. As mentioned above, the sub-compartment 150 may be referred to as an "icebox." In the illustrated exemplary embodiment, icebox 150 extends into fresh food chamber 122 when refrigerator door 128 is in the closed position. The general position of an ice maker assembly 175, and more particularly, the position of the ice maker assembly 175 relative to the icebox 150 and storage bin 220, is illustrated in FIG. 4.

As shown in FIG. 4, the ice maker assembly 175 may be positioned within the icebox 150. In additional embodiments, the icebox 150 may be omitted and the ice maker assembly 175 may be positioned directly within a chilled chamber, such as the freezer chamber, e.g., freezer chamber 124, of a refrigerator appliance or within a dedicated chilled chamber of a stand-alone ice maker appliance, e.g., an appliance which does not include a storage volume for receipt of food items. The ice maker assembly 175 is generally configured for freezing the water to form ice, e.g., ice pieces such as ice cubes, which may be stored in the ice storage bin 220 and dispensed through discharging outlet 146 by dispensing assembly 140. For example, the ice maker assembly 180 may include a mold body that may include one or more mold cavities defined therein, and liquid water may be directed into the mold cavity or cavities of the mold body and the water may then be retained therein at a temperature at or below the freezing point of water to form an ice piece or ice pieces. FIG. 4 illustrates the ice maker assembly 175 with an ice storage bin 220 positioned below the ice maker assembly 175 for receiving ice pieces from the mold body, e.g., for receiving the ice after the ice is ejected from the mold body. As those of ordinary skill in the art will recognize, ice from the mold body is collected and stored in the ice storage bin 220 and supplied to dispenser 144 (FIG. 1) from the ice storage bin 220 in icebox 150 on a back side of refrigerator door 128. Chilled air from a sealed system (not shown) of refrigerator appliance 100 may be directed into or onto components within the icebox 150, e.g., mold body and/or ice storage bin 220.

As mentioned above, the present disclosure may also be applied to other types and styles of refrigerator appliances such as, e.g., a top mount refrigerator appliance, a side-by-side style refrigerator appliance or a standalone ice maker appliance. Variations and modifications may be made to ice maker assembly while remaining within the scope of the present subject matter. Accordingly, the description herein of the icebox 150 on the door 128 of the fresh food chamber 122 is by way of example only. In other example embodiments, the ice maker assembly may be positioned in the freezer chamber 124, e.g., of the illustrated bottom-mount refrigerator, of a side by side refrigerator, of a top-mount refrigerator, or any other suitable refrigerator appliance. As another example, the ice maker assembly may also be provided in a standalone ice maker appliance. As used herein, the term "standalone ice maker appliance" refers to an appliance of which the sole or primary operation is generating or producing ice, e.g., without any additional or other chilled chambers other than the icebox, whereas the more general term "ice maker appliance" includes such appliances as well as appliances with diverse capabilities in addition to making ice, such as a refrigerator appliance equipped with an ice maker, among other possible examples.

As mentioned above, an access door 170 may be hinged to the inside of the refrigerator door 128. Access door 170 permits selective access to icebox 150. Any manner of suitable latch 172 may be configured with icebox 150 to maintain access door 170 in a closed position. As an example, latch 172 may be actuated by a consumer in order to open access door 170 for providing access into icebox 150. Access door 170 can also assist with insulating the icebox 150, e.g., by thermally isolating or insulating the icebox 150 from fresh food chamber 122.

It should be appreciated that any ice maker assembly may be utilized in connection with the present subject matter, for example, may be incorporated into the refrigerator appliance 100. For instance, the exemplary ice maker assembly 180 and the exemplary ice maker assembly 300 may be utilized in connection with the present subject matter and may be positioned within the ice box 150 such as the ice maker assembly 175. It should also be appreciated that the exemplary ice making assemblies described in more detail below are provided by way of example only and are not intended to limit the style or configuration of the ice maker assembly.

Figure 5:
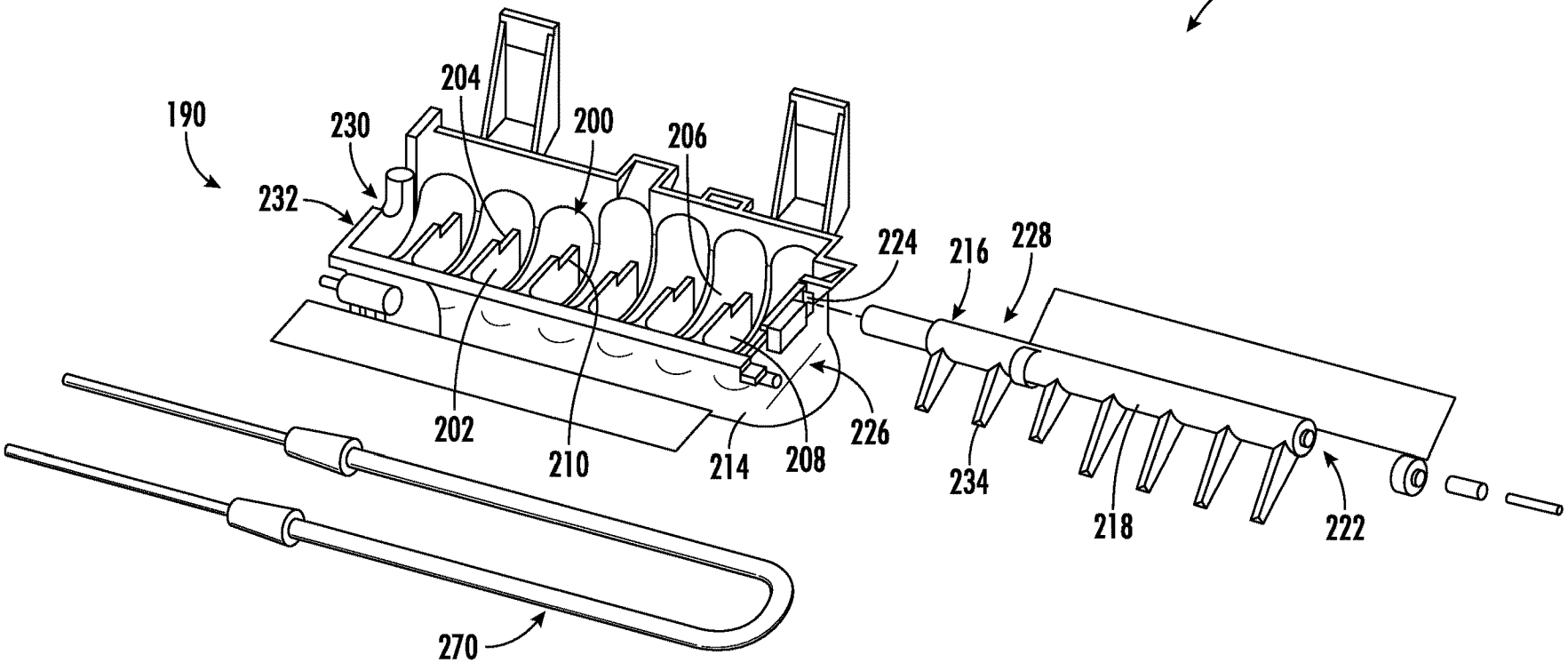
FIG. 5 provides an exploded perspective view of an exemplary ice maker assembly that may be incorporated into the refrigerator appliance of FIG. 1 according to one or more exemplary embodiments of the present subject matter.

For example, referring now to FIG. 5, an exemplary ice maker assembly 180 that may be incorporated in the refrigerator appliance 100 according to one or more exemplary embodiments of the present subject matter is provided. The ice maker assembly 180 may include a body or ice tray 190 including mold body 200 for receiving water and freezing the water therein to form ice. As shown, the ice tray 190 includes seven substantially identical ice forming compartments, e.g., cavities in the mold body 200, although it should be appreciated that more or less than seven ice forming compartments can be provided. In the illustrated embodiment, each compartment of mold body 200 includes an arcuate bottom surface 206. Also, as may be seen in FIG. 5, each compartment is divided by a partition wall 208 and each partition wall 208 includes a first side surface 202 and a second side surface 204 opposite the first side surface 202. The partition walls 208 extend transversely across the ice tray 190 to divide the ice forming compartments in which ice pieces (not shown) are formed, e.g., whereby fourteen ice pieces may be formed collectively in the seven compartments. Each partition wall 208 includes a recessed upper edge portion 210 through which water flows successively through each compartment of mold body 200 to fill the ice tray 190 with water.

The ice maker assembly 180 may also include a sheathed electrical resistance heating element or ice harvest heater 270 which may be mounted to a lower portion 214 of the ice tray 190. The heater can be press-fit, stacked, and/or clamped into lower portion 214 of ice tray 190. Ice harvest heater 270 is configured to heat mold body 200 when a harvest cycle is executed to slightly melt the ice and release the ice from the compartments of mold body 200.

A rake or ice ejector 216 is rotatably connected to ice tray 190. Ice ejector 216 includes an axle 218 and a plurality of ejector members 234 located in a common plane, e.g., extending radially from or tangent to axle 218, such as one ejector member for each compartment of mold body 200 or each ice piece formed therein. Axle 218 is concentric about the longitudinal axis of rotation of ice ejector 216. To rotatably mount ice ejector 216 to ice tray 190, a first end section 222 of ice ejector 216 is positioned adjacent an opening 224 located at a first end portion 226 of ice tray 190. A second end section 228 of ice ejector 216 is positioned in an arcuate recess 230 located on a second end portion 232 of ice tray 190. In the illustrated embodiment, ejector members 234 are triangular shaped projections and are configured to extend from axle 218 into the compartments of mold body 200 when ice ejector 216 is rotated. It is within the scope of the present disclosure for ejector members 234 to be fingers, shafts, or other structures extending radially beyond the outer walls of axle 218. Ice ejector 216 is rotatable relative to ice tray 190 from a closed first position to a second ice harvesting position and back to the closed position. Rotation of ice ejector 216 causes ejector members 234 to advance into the compartments of mold body 200 whereby ice located in each compartment is urged in an ejection path of movement out of the ice forming compartment and into storage bin 220.

Referring now to FIGS. 6 through 9, another exemplary ice maker assembly 300 according to one or more exemplary aspects of the present subject matter is provided. The ice maker assembly 300 may be positioned in any chilled chamber, e.g., fresh food chamber 122 or freezer chamber 124 of the refrigerator appliance 100. Particularly, the ice maker assembly 300 may be mounted in icebox 150 within ice making chamber 154 and is configured for receiving a flow of water from a water supply spout 302 More specifically, as described in more detail below, water supply spout 302 may discharge a flow of water into a fill cup that disperses or directs the water into one or more mold cavities.

Where the exemplary illustrated ice maker assembly 300 is mounted within the icebox 150 and the icebox 150 is defined by or in one of the refrigerator doors 128, the ice maker assembly 300 may thusly be positioned within the fresh food chamber 122, e.g., when the respective door 128 is in the closed position. In additional embodiments, the ice maker assembly 300 and ice storage bin 220 may be positioned, for example, in the freezer chamber 124. Accordingly, in various embodiments, the ice making chamber 154 may be located within one of the chilled chambers or may be coextensive with one of the chilled chambers. For example, in some embodiments, the icebox 150 may be defined in or by the freezer door 130, whereby the ice making chamber 154 may be positioned within the freezer chamber 124, e.g., when the freezer door 130 is in the closed position, or the icebox 150 may be defined in a stationary location within the freezer chamber 124, whereby the ice making chamber 154 may be positioned within the freezer chamber 124 independent of the position of the freezer door 130. As another example, in additional embodiments the icebox 150 may be omitted and the ice maker assembly 300 and the ice storage bin 220 may be located within the freezer chamber 124, e.g., the ice making chamber 154 and the freezer chamber 124 may be commensurate and coextensive in such embodiments. Thus, the ice making chamber 154 may be defined in one of the housing 102 and the doors 128, 130, such as the ice making chamber 154 may be defined in one of the doors 128 or 130 when the icebox 150 is provided in the one of the doors 128 or 130, or the ice making chamber 154 may be defined in the cabinet when the icebox 150 is mounted in one of the chilled chamber 122 and 124 or when the icebox 150 is omitted.

In this manner, ice maker assembly 300 is generally configured for freezing the water to form ice cubes 304 (see, e.g., FIGS. 7 and 8, also note that the term "ice cubes" is used broadly herein to include ice pieces of various shapes such as but not limited to rectangular prisms, gem-shaped ice pieces, ice nuggets, or any other desired shape for the ice "cubes") which may be stored in ice storage bin 220 and dispensed through discharging outlet 146 by dispensing assembly 140. However, it should be appreciated that ice maker assembly 300 is described herein only for the purpose of explaining aspects of the present subject matter. Variations and modifications may be made to ice maker assembly 300 while remaining within the scope of the present subject matter. For example, ice maker assembly 300 could instead be positioned within freezer chamber 124 of refrigerator appliance 100 and may have any other suitable configurations.

According to the illustrated embodiment, ice maker assembly 300 includes a mold body 310 that defines a mold cavity 312. In general, as described in more detail below, mold body 310 may be positioned for receiving the gravityassisted flow of water from water supply spout 302 and containing that water until ice cubes 304 are formed. Mold body 310 may be constructed from any suitably resilient material that may be deformed to release ice cubes 304 after formation. For example, according to the illustrated embodiment, mold body 310 is formed from silicone or another suitable hydrophobic, food-grade, and resilient material.

In some exemplary embodiments, mold body 310 defines two mold cavities 312, each being shaped and oriented for forming a separate ice cube 304. In this regard, for example, water supply spout 302 is configured for refilling mold body 310 to a level above a divider wall (not shown) within mold body 310 such that the water overflows into each of the mold cavities 312 evenly, e.g., evenly into both mold cavities in the example embodiment illustrated in FIG. 6, or other suitable number of mold cavities as may be provided in various embodiments, such as multiple rows of mold cavities, etc. According to still other embodiments, water supply spout 302 could have a dedicated discharge nozzle positioned over each mold cavity 312. Furthermore, it should be appreciated that according to alternative embodiments, ice maker assembly 300 may be scaled to form any suitable number of ice cubes 304, e.g., by increasing the number of mold cavities 312 defined by mold body 310.

As shown, ice maker assembly 300 further includes a fill cup 314 that is positioned above mold body 310 for selectively filling mold cavity 312 with water. More specifically, fill cup 314 may be positioned below water supply spout 302 for receiving a flow of water 316. The fill cup 314 may define a small reservoir for collecting and/or directing the flow of water 316 into mold cavity 312 without excessive splashing or spilling. In addition, fill cup 314 may define a discharge spout 318 that funnels water toward the bottom of the fill cup 314 where it may be dispensed into mold cavity 312.

In general, fill cup 314 and discharge spout 318 may have any suitable size, shape, and configuration suitable for dispensing the flow of water 316 into mold body 310. For example, according to the illustrated embodiment, fill cup 314 is positioned over one of the two mold cavities 312 and generally defines sloped surfaces for directing the flow of water 316 to discharge spout 318 immediately above a fill level (not labeled) of the mold body 310. According to alternative embodiments, fill cup 314 may extend across a width of the entire mold body 310 and may have multiple discharge spouts 318. Fill cup 314 may have still other configurations while remaining within the scope of the present subject matter.

Ice making assembly 300 may further include a heat exchanger 320 which is in thermal communication with mold body 310 for freezing the water within mold cavities 312 to form one or more ice cubes 304. In general, heat exchanger 320 may be formed from any suitable thermally conductive material and may be positioned in direct contact with mold body 310. Specifically, according to the illustrated embodiment, heat exchanger 320 is formed from aluminum and is positioned directly below mold body 310. Furthermore, heat exchanger 320 may define a cube recess 322 which is configured to receive mold body 310 and shape or define the bottom of ice cubes 304. In this manner, heat exchanger 320 is in direct contact with mold body 310 over a large portion of the surface area of ice cubes 304, e.g., to facilitate an increased rate of heat transfer and quick freezing of the water stored within mold cavities 312. For example, heat exchanger 320 may contact mold body 310 over greater than approximately half of the surface area of ice cubes 304.

Figure 7:
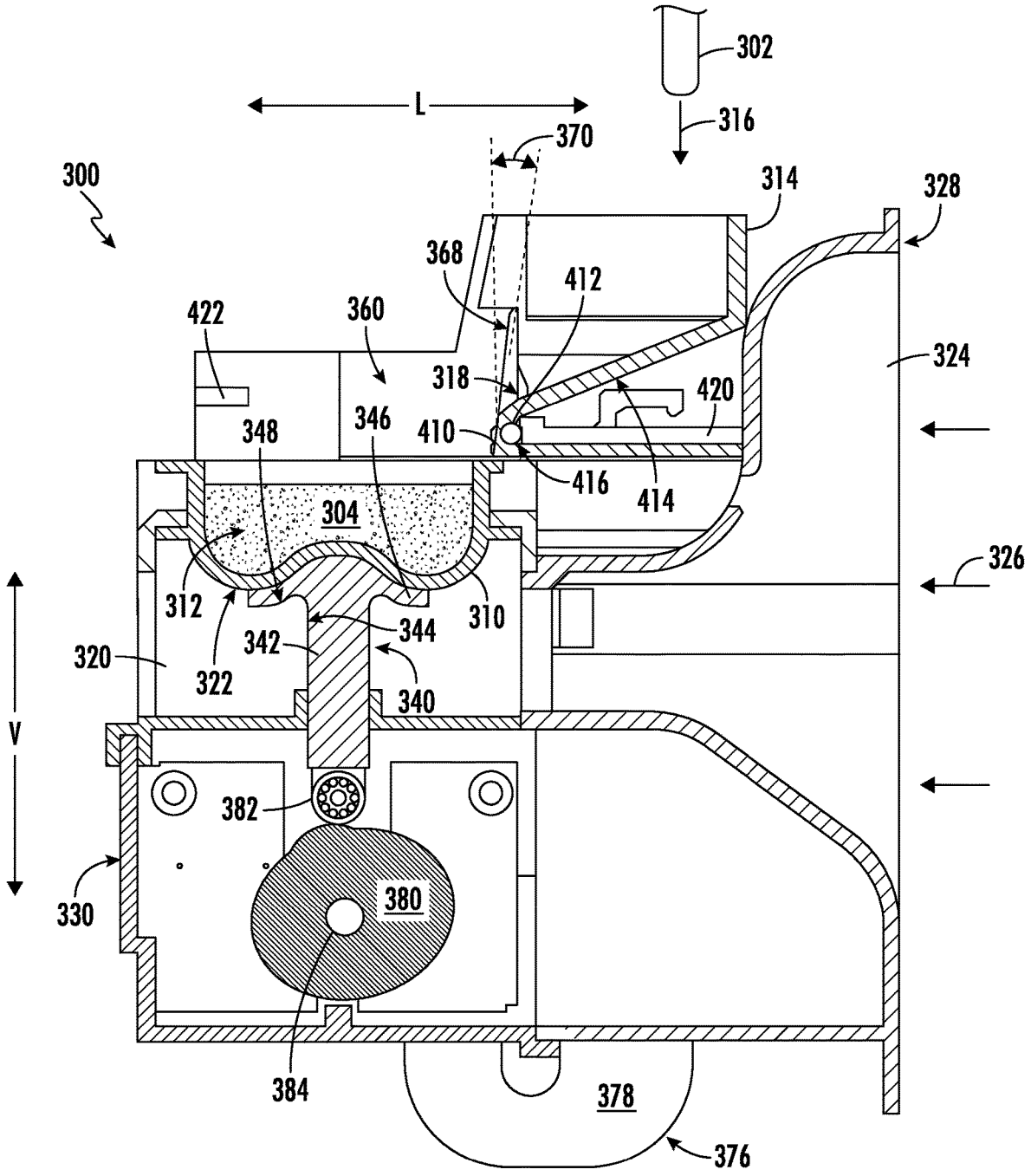
FIG. 7 provides a partial side view of a drive mechanism, a lifter mechanism, and a sweep assembly of the exemplary ice maker assembly of FIG. 6, with the lifter mechanism in a lowered position and the sweep assembly in the retracted position.
Figure 8:
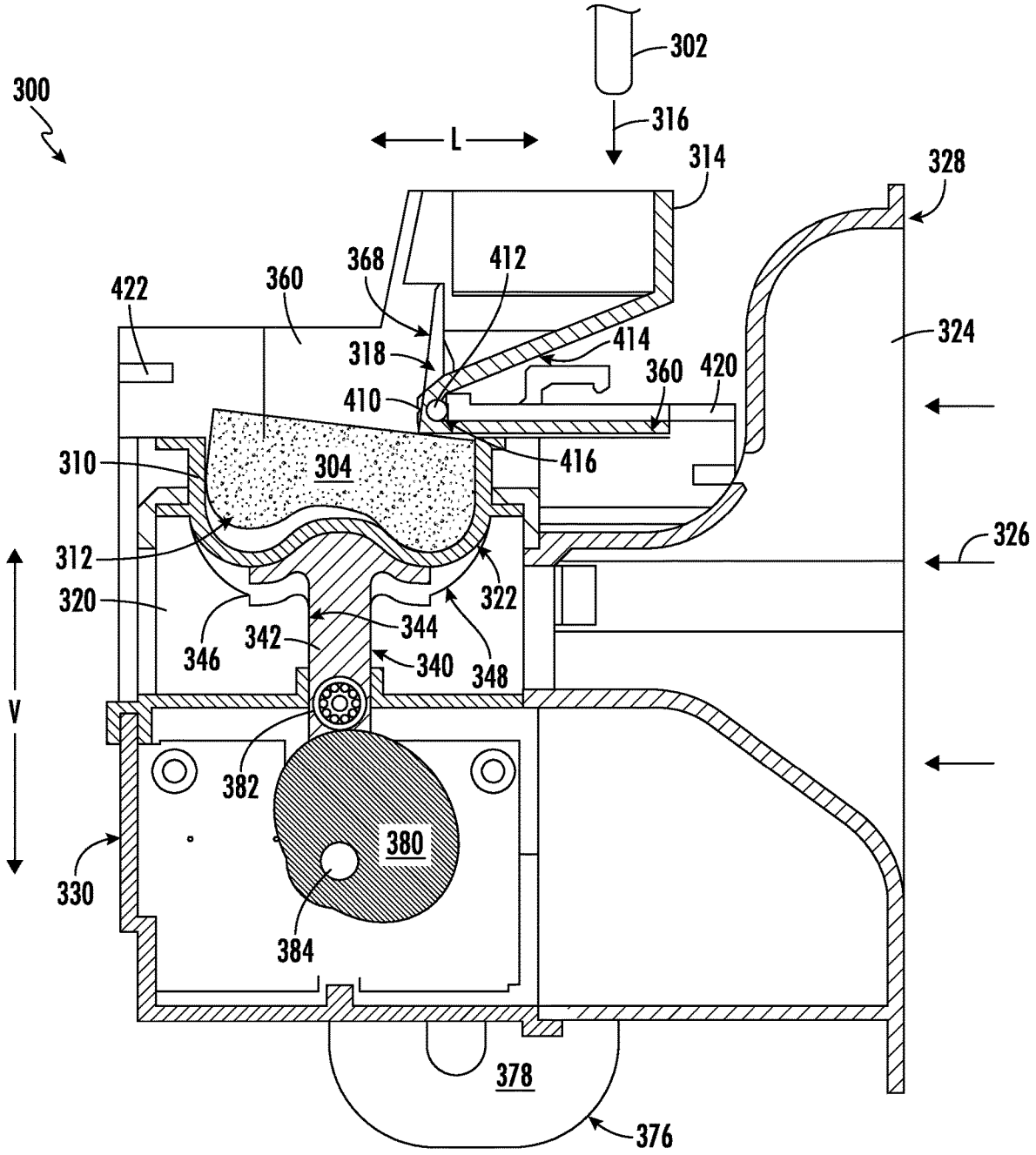
FIG. 8 provides a partial side view of the drive mechanism, the lifter mechanism, and the sweep assembly of FIG. 7 with the lifter mechanism in the raised position.

In addition, ice maker assembly 300 may comprise an inlet air duct 324 that is positioned adjacent heat exchanger 320 and is fluidly coupled with a cool air supply (e.g., illustrated as a flow of cooling air 326). According to the illustrated embodiment, inlet air duct 324 provides the flow of cooling air 326 from a rear end 328 of ice maker assembly 300 (e.g., from the right along the lateral direction L as shown in FIGS. 7 and 8) through heat exchanger 320 toward a front end 330 of ice maker assembly 300 (e.g., to the left along the lateral direction L as shown in FIGS. 7 and 8, e.g., the side where ice cubes 304 may be discharged into ice storage bin 220).

As shown, inlet air duct 324 generally receives the flow of cooling air 326 from a sealed system of refrigerator appliance 100 and directs it over and/through heat exchanger 320 to cool heat exchanger 320. More specifically, according to the illustrated embodiment, heat exchanger 320 defines a plurality of heat exchange fins 332 that extend substantially parallel to the flow of cooling air 326. In this regard, heat exchange fins 332 extend down from a top of heat exchanger 320 along a plane approximately defined by the vertical direction V and the lateral direction L (e.g., when ice maker assembly 300 is installed in refrigerator appliance 100).

As may be seen, e.g., in FIGS. 7 and 8, ice maker assembly 300 further includes a lifter mechanism 340 that is positioned below mold body 310 and is generally configured for facilitating the ejection of ice cubes 304 from mold cavities 312. In this regard, lifter mechanism 340 is movable between a lowered position (e.g., as shown in FIG. 7) and a raised position (e.g., as shown in FIG. 8). Specifically, lifter mechanism 340 includes a lifter arm 342 that extends substantially along the vertical direction V and passes through a lifter channel 344 defined within heat exchanger 320. In this manner, lifter channel 344 may guide lifter mechanism 340 as it slides approximately along the vertical direction V.

In addition, lifter mechanism 340 comprises a lifter projection 346 that extends from a top of lifter arm 342 towards a rear end 328 of ice maker assembly 300 and towards a front end 330 of ice maker assembly 300. As illustrated, lifter projection 346 generally defines the profile of the bottom of ice cubes 304 and is positioned flush within a lifter recess 348 defined by heat exchanger 320 when lifter mechanism 340 is in the lowered position. In this manner, heat exchanger 320 and lifter projection 346 define a smooth bottom surface of ice cubes 304. More specifically, according to the illustrated embodiment, lifter projection 346 generally curves down and away from lifter arm 342 to define a smooth divot on a bottom of ice cubes 304.

Figure 9:
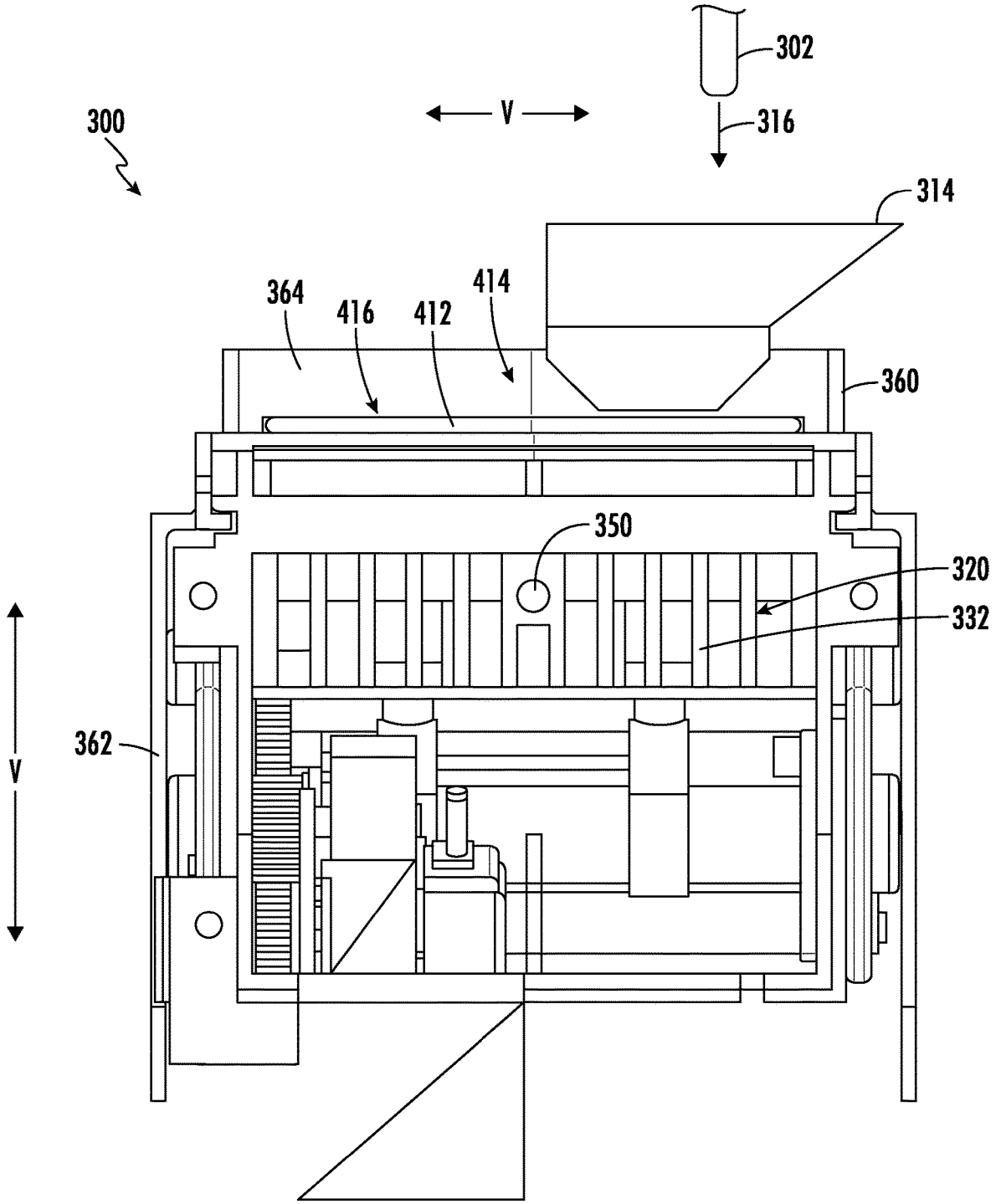
FIG. 9 provides a rear view of the exemplary ice maker assembly of FIG. 6 according to an exemplary embodiment with a retention bracket removed for clarity.

Referring now specifically to FIG. 9, heat exchanger 320 may further define a hole for receiving a temperature sensor 350 which is used to determine when ice cubes 304 have been formed such that an ejection process may be performed. In this regard, for example, temperature sensor 350 may be in operative communication with controller 164 which may monitor the temperature of heat exchanger 320 and the time water has been in mold cavities 312 to predict when ice cubes 304 have been fully frozen.

As used herein, "temperature sensor" or the equivalent is intended to refer to any suitable type of temperature measuring system or device positioned at any suitable location for measuring the desired temperature. Thus, for example, temperature sensor 350 may each be any suitable type of temperature sensor, such as a thermistor, a thermocouple, a resistance temperature detector, a semiconductor-based integrated circuit temperature sensor, etc. In addition, temperature sensor 350 may be positioned at any suitable location and may output a signal, such as a voltage, to a controller, such as the controller 164 of refrigerator appliance 100, that is proportional to and/or indicative of the temperature being measured. Although exemplary positioning of temperature sensors is described herein, it should be appreciated that the refrigerator appliance 100 may include any other suitable number, type, and position of temperature, humidity, and/or other sensors according to alternative embodiments.

The ice maker assembly 300 further includes a sweep assembly 360 which is positioned over mold body 310 and is generally configured for pushing ice cubes 304 out of mold cavities 312 and into storage bin 220 after they are formed. Specifically, according to the illustrated embodiment, sweep assembly 360 is movable along the horizontal direction (i.e., within a horizontal plane generally perpendicular to the vertical direction V, such as a lateral-transverse plane defined by the lateral direction L and the transverse direction T) between a retracted position (e.g., as shown in FIG. 7) and an extended position (e.g., as shown in FIG. 8). According to the illustrated embodiment, sweep assembly 360 and fill cup 314 may be integrally formed as a single piece, with fill cup 314 being positioned on top of sweep assembly 360. In this manner, sweep assembly 360 and fill cup 314 may move in unison along a horizontal direction, e.g., the lateral direction L or other direction generally perpendicular to the vertical direction V, during the ice discharge process.

As described in more detail below, sweep assembly 360 remains in the retracted position while water is added to mold body 310, e.g., through fill cup 314. Sweep assembly 360 also remains in the retracted position throughout the entire freezing process, and as lifter mechanism 340 is moved towards the raised position. After ice cubes 304 are in the raised position, sweep assembly 360 moves horizontally from the retracted position to the extended position, e.g., toward front end 330 of ice maker assembly 300. In this manner, sweep assembly 360 pushes ice cubes 304 off of lifter mechanism 340, out of mold body 310, and over a top of heat exchanger 320 where they may fall into storage bin 220.

Notably, dispensing ice cubes 304 from the top of ice maker assembly 300 permits a taller storage bin 220, and thus a larger ice storage capacity relative to ice making machines that dispense ice from a bottom of the icemaker. According to the illustrated embodiment, water supply spout 302 is positioned above fill cup 314 (in the retracted position) such that the flow of water may be directed into mold body 310. In addition, water supply spout 302 is positioned such that sweep assembly 360 may move between the retracted position and the extended position without contacting water supply spout 302. According to alternative embodiments, water supply spout 302 may be coupled to mechanical actuator which lowers water supply spout 302 close to mold body 310 while sweep assembly 360 is in the retracted position. In this manner, the overall height or profile of ice maker assembly 300 may be further reduced, thereby maximizing ice storage capacity, and minimizing wasted space.

According to the illustrated embodiment, sweep assembly 360 generally includes vertically extending side arms 362 that are used to drive a raised frame 364 that is positioned over, e.g., above, mold body 310. Specifically, raised frame 364 extends around mold body 310 and thereby prevents or reduces splashing of water within mold body 310. This may be advantageous, such as when ice maker assembly 300 is mounted on refrigerator door 128 because movement of refrigerator door 128 may cause sloshing of water within mold cavities 312.

In addition, as best shown in FIGS. 7 and 8, sweep assembly 360 may further define an angled pushing surface 368 proximate rear end 328 of ice maker assembly 300. In general, angled pushing surface 368 is configured for engaging ice cubes 304 while they are pivoted upward and as sweep assembly 360 is moving toward the extended position to rotate ice cubes 304 over and out of ice maker assembly 300. Specifically, angled pushing surface may extend at an angle 370 (FIG. 7) relative to the vertical direction V. According to the illustrated embodiment, angle 370 is less than about 10 degrees, though any other suitable angle for urging ice cubes to rotate 180 degrees may be used according to alternative embodiments.

The ice maker assembly 300 may include a drive mechanism 376 which is operably coupled to both lifter mechanism 340 and sweep assembly 360 to selectively raise lifter mechanism 340 and slide the sweep assembly 360 to discharge ice cubes 304 during operation. Specifically, according to the illustrated embodiment, drive mechanism 376 comprises a drive motor 378. As used herein, "motor" may refer to any suitable drive motor and/or transmission assembly for rotating a system component. For example, motor 378 may be a brushless DC electric motor, a stepper motor, or any other suitable type or configuration of motor. Alternatively, for example, motor 378 may be an AC motor, an induction motor, a permanent magnet synchronous motor, or any other suitable type of AC motor. In addition, motor 378 may include any suitable transmission assemblies, clutch mechanisms, or other components.

According to an exemplary embodiment, motor 378 may be mechanically coupled to a rotating cam 380. Lifter mechanism 340, or more specifically lifter arm 342, may ride against rotating cam 380 such that the profile of rotating cam 380 causes lifter mechanism 340 move between the lowered position and the raised position as motor 378 rotates rotating cam 380. In addition, according to an exemplary embodiment, lifter mechanism 340 may include a roller 382 mounted to the lower end of lifter arm 342 for providing a low friction interface between lifter mechanism 340 and rotating cam 380.

Ice making assembly 300 may include a plurality of lifter mechanisms 340, each of the lifter mechanisms 340 being positioned below one of the mold cavities 312 of the mold body 310 (and ice cubes 304 therein) or being configured to raise a separate portion of mold body 310. In such an embodiment, rotating cams 380 are mounted on a cam shaft 384 which is mechanically coupled with motor 378. As motor 378 rotates cam shaft 384, rotating cams 380 may simultaneously move lifter arms 342 along the vertical direction V. In this manner, each of the plurality of rotating cams 380 may be configured for driving a respective one lifter mechanism 340. In addition, a roller axle (not shown) may extend between rollers 382 of adjacent lifter mechanisms 340 to maintain a proper distance between adjacent rollers 382 and to keep them engaged on top of rotating cams 380.

The drive mechanism 376 may further include a yoke wheel 390 which is mechanically coupled to motor 378 for driving sweep assembly 360. Specifically, yoke wheel 390 may rotate along with cam shaft 384 and may include a drive pin 392 positioned at a radially outer portion of yoke wheel 390 and extending substantially parallel to an axis of rotation of motor 378. In addition, side arms 362 of sweep assembly 360 may define a drive slot 394 which is configured to receive drive pin 392 during operation. Although a single yoke wheel 390 is described and illustrated herein, it should be appreciated that both side arms 362 may include yoke wheel 390 and drive slot 394 mechanisms.

Notably, the geometry of each drive slot 394 is defined such that drive pin 392 moves sweep assembly 360 along the horizontal direction when drive pin 392 reaches an end 396 of drive slot 394. Notably, according to an exemplary embodiment, this occurs when lifter mechanism 340 is in the raised position. In order to provide controller 164 with knowledge of the position of yoke wheel 390 (and drive mechanism 376 more generally), ice maker assembly 300 may include a position sensor (not shown) for determining a zero position of yoke wheel 390.

According to an exemplary embodiment, the position sensor includes a magnet (not shown) positioned on yoke wheel 390 and a Hall-effect sensor (not shown) mounted at a fixed position on ice maker assembly 300. As yoke wheel 390 is rotated toward a predetermined position, the Hall-effect sensor can detect the proximity of the magnet and controller 164 may determine that yoke wheel 390 is in the zero position (or some other known position). Alternatively, any other suitable sensors or methods of detecting the position of yoke wheel 390 or drive mechanism 376 may be used. For example, motion sensors, camera systems, optical sensors, acoustic sensors, or simple mechanical contact switches may be used according to alternative embodiments.

According to an exemplary embodiment of the present subject matter, motor 378 may begin to rotate after ice cubes 304 are completely frozen and ready for harvest. In this regard, motor 378 rotates rotating cam 380 (and/or cam shaft 384) approximately ninety degrees (90°) to move lifter mechanism 340 from the lowered position to the raised position. In this manner, lifter projection 346 pushes mold body 310 upward, thereby deforming mold body 310 and releasing ice cubes 304. Ice cubes 304 continue to be pushed upward until they pass into storage bin 220.

Notably, yoke wheel 390 rotates with cam shaft 384 such that drive pin 392 rotates within drive slot 394 without moving sweep assembly 360 until yoke wheel 390 reaches the ninety-degree position. Thus, as motor 378 rotates past ninety degrees (90°), lifter mechanism 340 remains in the raised position while sweep assembly 360 moves towards the extended position. In this manner, angled pushing surface 368 engages the raised end of ice cubes 304 to push them out of mold body 310 and rotates ice cubes 304 approximately one hundred and eighty degrees (180°) before dropping them into storage bin 220.

When motor 378 reaches one hundred and eighty degrees (180°) rotation, sweep assembly 360 is in the fully extended position and ice cubes 304 will fall into storage bin 152 under the force of gravity. As motor 378 rotates past one hundred and eighty degrees (180°), drive pin 392 begins to pull sweep assembly 360 back toward the retracted position, e.g., via engagement with drive slot 394. Simultaneously, the profile of rotating cam 380 is configured to begin lowering lifter mechanism 340. When motor 378 is rotated back to the zero position, as indicated for example by a position sensor, sweep assembly 360 may be fully retracted, lifter mechanism 340 may be fully lowered, and mold body 310 may be ready for a supply fresh water. At this time, water supply spout 302 may provide a flow of fresh water into mold cavities 312 and the process may be repeated.

Notably, due to the proximity of fill cup 314 to cold air and temperatures necessary for forming ice cubes 304, water 316 dispensed from water supply spout 302 may have a tendency to freeze in locations where ice is not desirable. When such undesirable freezing occurs, the operation and performance of ice maker assembly 300 may be negatively affected. For example, water fill volumes may be affected, resulting in ice cubes that are smaller or larger than desired. In addition, ice in the wrong places may cause water spills or may jam the discharge mechanisms of ice maker assembly 300. Thus, some exemplary embodiments of the ice maker assembly 300 may include features for eliminating the buildup of ice in undesirable locations. These undesirable ice formations may be referred to herein as ice clogs 410 (see, FIGS. 6 through 8).

Specifically, ice maker assembly 300 may include one or more heating elements 412 that are in thermal communication with fill cup 314 for selectively heating fill cup 314. As used herein, the term "heating element" and the like are generally intended to refer to any suitable electrically driven heat generator. For instance, the heating element 412 may be an electric heater in conductive thermal engagement with fill cup 314 and may include one or more resistive heating elements. For example, positive thermal coefficient of resistance heaters (PTCR) that increase in resistance upon heating may be used, such as metal, ceramic, or polymeric PTC elements (e.g., such as electrical resistance heating rods or calrod heaters). In addition, heating elements 412 may be coated in silicone, embedded within fill cup 314, or positioned in any other suitable manner.

Heating element 412 may generally be mounted in any manner suitable for breaking up ice clogs 410 or melting undesirable ice buildup. In this regard, according to the exemplary embodiment, heating element 412 may be positioned adjacent discharge spout 318 of fill cup 314. In this regard, a common clogging location is at the point where discharge spout 318 directs the flow of water 316 into mold cavity 312. Notably, the ice clog 410 at this location may prevent proper discharge or ejection of ice cubes 304 from mold cavities 312. In this regard, as lifter mechanism 340 pushes ice cube 304 up and out of mold body 310, a back end of ice cube 304 may contact the ice clog 410 causing it to tilt forward. As sweep assembly 360 moves forward to initiate the ejection process, ice cube 304 can get jammed between sweep assembly 360 and a front of mold body 310.

To prevent such issues, heating element 412 may be selectively energized when such an ice clog 410 is detected to locally melt and break up the ice clog 410. Specifically, according to the illustrated embodiment, heating element 412 is positioned on a back side 414 of fill cup 314 immediately opposite discharge spout 318. In this regard, fill cup 314 may define a groove 416 that it is sized for receiving heating element 412. Groove 416 may be defined such that the thickness of fill cup 314 adjacent groove 416 is less than a nominal thickness of sweep assembly 360 and fill cup 314. Thus, heating element 412 is positioned as close as possible to ice clog 410 without comprising the structural integrity of fill cup 314.

In addition, ice maker assembly 300 may include a retention bracket 420 that snaps onto fill cup 314 or sweep assembly 360 to secure heating element 412 in position. In this manner, retention bracket 420 may be a flat piece of plastic that is positioned firmly against heating element 412 opposite of fill cup 314. In this manner, heating element 412 may be in firm contact with fill cup 314 within groove 416 for improved thermal conductivity. As shown, retention bracket 420 may include clips 422 that are received within a notch defined on a front end of sweep assembly 360 to secure the retention bracket 420 in place. It should be appreciated that other configurations of retention bracket 420 and other means for securing heating element 412 may be used while remaining within the scope of the present subject matter.

Notably, localized heating at discharge spout 318 may prevent ice clogs 410 at discharge spout 318 but may be ineffective at melting ice clogs 410 positioned elsewhere within ice maker assembly 300. Thus, according to alternative embodiments, ice maker assembly 300 may further include a secondary harvest heater in thermal communication with heat exchanger 320. Such secondary harvest heater may be used independently of or in conjunction with heating element 412 to clear the ice clogs 410 throughout ice maker assembly 300.

Figure 10:
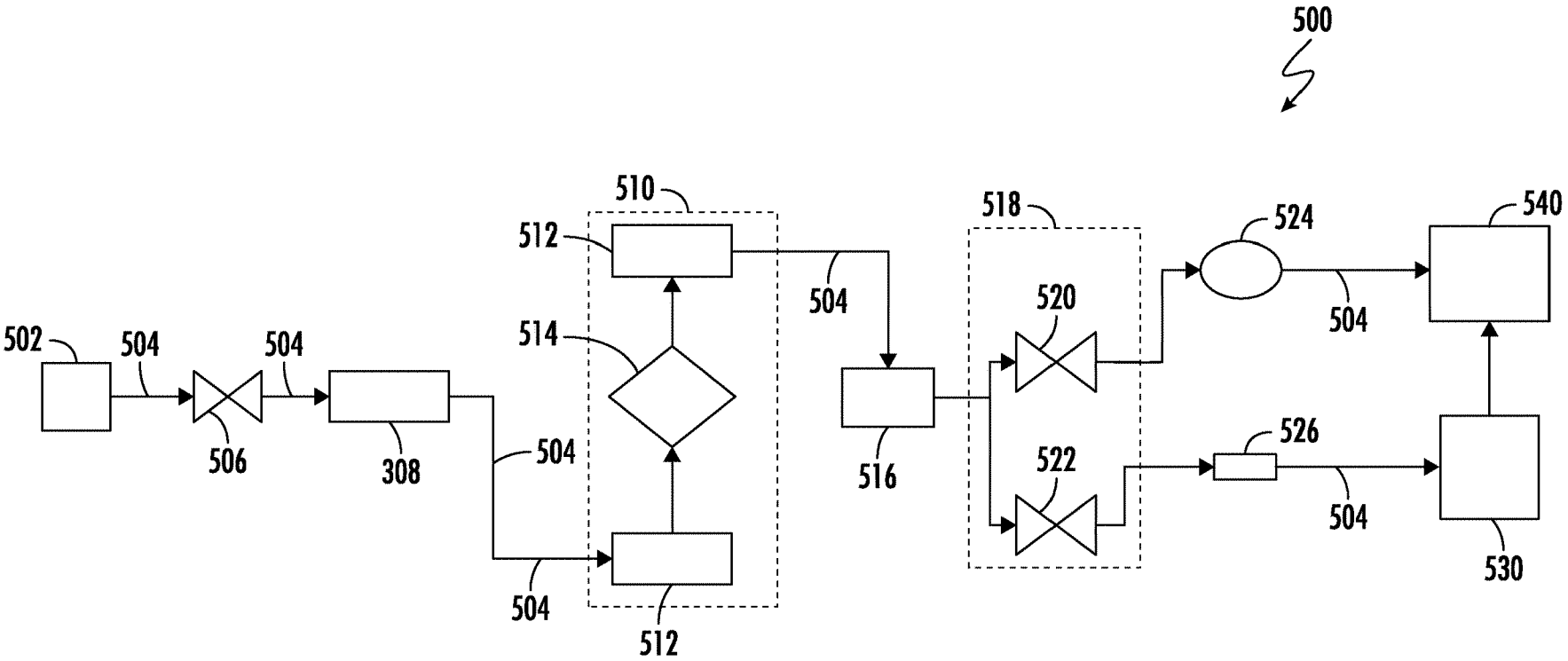
FIG. 10 provides a schematic diagram of an ice maker appliance according to one or more exemplary embodiments of the present subject matter.

Referring now to FIG. 10, a schematic diagram of an ice maker appliance 500 according to one or more exemplary embodiments of the present subject matter is provided. One of ordinary skill in the art would understand that the schematic diagram of the ice maker appliance 500 described herein, and illustrated in FIG. 10, may be a schematic diagram of any suitable ice maker appliance. For example, the schematic diagram of the ice maker appliance 500 may be provided to illustrate a schematic diagram of a standalone ice maker appliance. As another example, the schematic diagram of the ice maker appliance 500 may be provided to illustrate an appliance with diverse capabilities in addition to making ice, for instance, a refrigerator appliance equipped with an ice maker assembly such as the refrigerator appliance 100.

In some embodiments, the exemplary ice maker appliance 500 may include a water supply 502. The water supply 502 may be, for example, a water utility supply or a private source water supply, such as a private well. In addition, in some embodiments, the ice maker appliance 500 may include a water supply line 504 that may provide the liquid water from the water supply 502 to an ice maker assembly 530 of the ice maker appliance 500. Though not depicted, it should be appreciated that a flow of the liquid water from the water supply 502 may be generated, for example, by a pump of the ice maker assembly 300. It should also be appreciated that the ice maker assembly 530 may be any suitable ice maker assembly, for example, in some embodiments, the ice maker assembly 530 may be configured as the ice maker assembly 180 or the ice maker assembly 300.

Moreover, in some embodiments, the ice maker appliance 500 may include an isolation valve 506 coupled in-line with the water supply line 504. The flow of liquid water may be permitted to flow to the ice maker assembly 530 by opening the isolation valve 506. Additionally, in some embodiments, ice maker appliance 500 may include a case back water line 308 that may be coupled in line with the water supply line 504, and more particularly positioned downstream of the isolation valve 506. The case back water line 308 may be provided to prevent a back flow of liquid water from reaching the isolation valve 506 and more particularly, the water supply 502.

Furthermore, in some embodiments, the ice maker appliance 500 may include a water filter assembly 510. The water filter assembly 510 may include a water filter manifold 512 that may be coupled in-line with the water supply line 504 and a filter 514 that may be provided to filter the liquid water, e.g., to remove or reduce the concentration of particulate matter that may be present in the liquid water. Though depicted as two separate blocks, water filter manifold 512 may be a single manifold that may hold and fluidly couple the filter 514 to the flow of liquid water provided through the water supply line 504.

Figure 6:
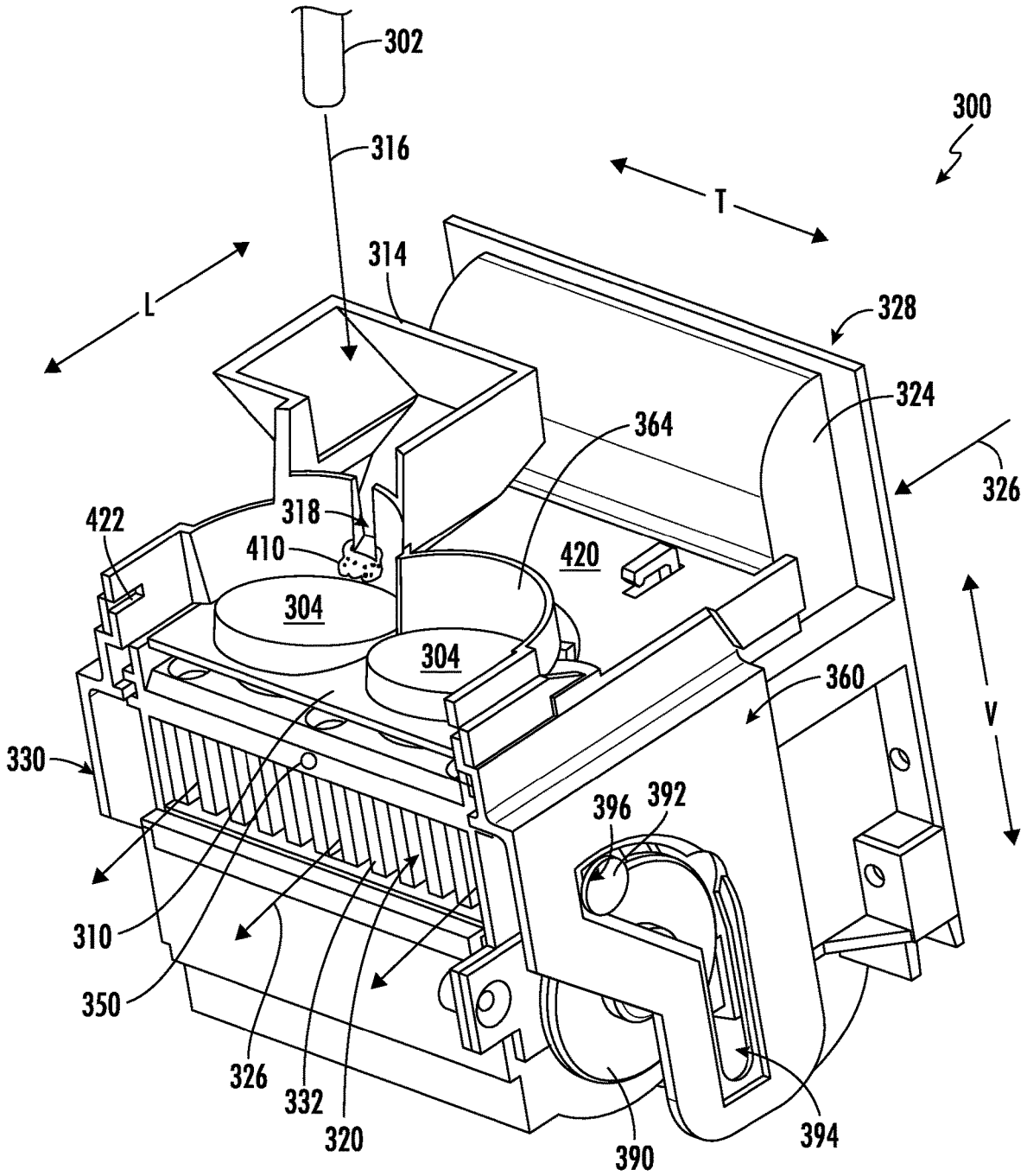
FIG. 6 provides a perspective view of another exemplary ice maker assembly that may be incorporated into the refrigerator appliance of FIG. 1 according to one or more exemplary embodiments of the present subject matter.

In some embodiments, the ice maker appliance 500 may include a flow meter 516 coupled in-line with the water supply line 504 for measuring a flow rate of the liquid water that may be supplied to the ice maker assembly 530, and more particularly, to a mold body, such as mold body 200 of FIG. 5 or mold body 310 of FIG. 6, of the ice maker assembly 530.

In some embodiments, the ice maker appliance 500 may also include water valve assembly 518 that may be provided to direct liquid water directly to a dispenser assembly 540, to the ice maker assembly 530, or a combination thereof. As illustrated, the water valve assembly 518 may include a dispense valve 520 provided to permit a flow of liquid water to the dispenser assembly 540 and an ice maker valve 522 provided to permit a flow of liquid water to the ice maker assembly 530. Though illustrated as separate valves, in some embodiments, the dispense valve 520 and the ice maker valve 522 may be a single valve that may selectively permit a flow of liquid water to the dispenser assembly, the ice maker assembly, or a combination thereof. For example, in some embodiments, the dispense valve 520 and the ice maker valve 522 may be combined into a single, three-way valve.

In some embodiments, the ice maker appliance 500 may include a coil tank 524 coupled in-line with the dispense valve 520. The coil tank 524 may be provided to chill, for example, lower the temperature of the flow of liquid water provided by the opening of the dispense valve 520. For instance, the coil tank 524 may chill the flow of liquid water to a desirable drinking temperature that may have been inputted by a user of the ice maker appliance 500.

The ice maker appliance 500 may also include a fill tube 526 that may be adapted to direct water from the water supply line 504 to the ice maker assembly 530. As such, in some embodiments, the fill tube 526 may be positioned directly upstream of the ice maker assembly 530 to provide a fill of liquid water to the ice maker assembly 530, such as by introducing water to the compartments of a mold body of the ice maker assembly 530. Such liquid water is chilled to or below the freezing temperature of water such that liquid water flowing within compartments of the mold body can freeze and form ice pieces. In addition, in some embodiments, the ice maker appliance 500 may include an ice storage bin (not depicted), for example, ice storage bin 220 of refrigerator appliance 100, that may collect and hold ice that may be harvested from the mold body.

Furthermore, in some embodiments, the ice maker appliance 500 may include a dispenser assembly 540. The dispenser assembly 540 may be positioned downstream of the coil tank 524 and the ice maker assembly 530 and may be configured to dispense liquid water, ice that may be stored within the ice storage bin, or a combination thereof.

Figure 11:
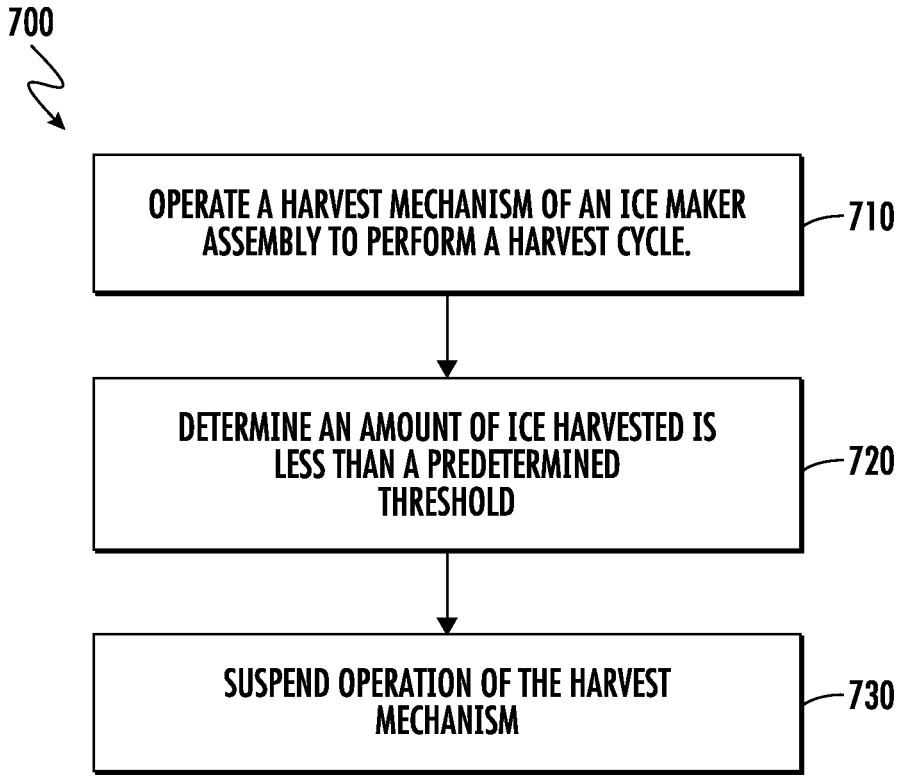
FIG. 11 provides an exemplary flow chart of a method of operating an ice maker appliance according to one or more exemplary embodiments of the present subject matter.

Referring now to FIG. 11, embodiments of the present subject matter may include a method for operating an ice maker appliance, such as the exemplary ice maker appliances 100, and 500 described above, as well as other possible exemplary ice maker appliances. The exemplary method according to the present subject matter may include method 700 illustrated in FIG. 11. A controller of ice maker appliance, such as the controller 164 of the refrigerator appliance 100 may be programmed to implement method 700, e.g., the controller, such as controller 164, may be capable of and may be operable to perform any methods and associated method steps as disclosed herein.

As illustrated in FIG. 11, the method 700 may include a step 710 of operating a harvest mechanism of an ice maker assembly to perform a harvest cycle, whereby an amount of ice is harvested from the ice maker appliance. In some embodiments, the harvest mechanism of the ice maker assembly may be the mechanism, or a combination of mechanisms, that may be utilized to eject or remove formed ice from the ice maker assembly, and more particularly from a mold body, such as mold body 200 of FIG. 5 or mold body 310 of FIG. 6, of the ice maker assembly. For example, the harvest mechanism of ice maker assembly 180 may be the ice ejector 216. As another example, the harvest mechanism of the ice maker assembly 300 may include a combination of the lifter mechanism 340, the sweep assembly 360, and the drive mechanism 376. The harvest mechanism may also include a heating element or harvest heater, such as ice harvest heater 270 (FIG. 5) or other suitable harvest heater. The harvest mechanism of the ice maker assembly may be able to cycle through one or more harvest cycles, for example, to harvest ice that may have formed within the mold body of the ice maker assembly. As such, in some embodiments, the harvest cycle may be one of a plurality of harvest cycles. Moreover, in some instances, such as with reference to the exemplary ice maker assembly 180 of FIG. 5, operating the harvest mechanism may include rotating the ice ejector 216 to urge ice that may have been formed within the compartments of the mold body 200 out of the compartments of the mold body 200.

In some embodiments, the ice maker assembly may be configured such that when the ice storage bin is filled with ice, the harvesting of ice may be suspended as there may no longer be space within the ice storage bin for more ice to be stored. For example, in some embodiments, the ice maker assembly may include a sensor that may sense, e.g., detect, when the ice storage bin is completely filled. When it is sensed that the ice storage bin is completely filled, a signal may be sent to the harvest mechanism, for example by a controller, such as the controller 164, that suspends operation of the harvest mechanism, e.g., as there may not be enough space for additional ice to be adequately stored within the ice storage bin. However, in some instances, the ice maker assembly may "dry cycle" or may perform a harvest cycle when no ice has been formed within the mold body. A dry cycle of the ice maker assembly may occur due to a variety of complications. For example, when a water supply, such as water supply 502, is obstructed, limited, not properly connected, or otherwise unavailable, the ice maker assembly may dry cycle which may result in the amount of ice harvested being less than a full capacity of the ice storage bin. In such instances, the amount of ice harvested may be as low as zero, e.g., no ice may be harvested.

Thus, method 700 may further include a step 720 of determining the amount of ice harvested is less than a predetermined threshold. In some embodiments, the predetermined threshold may be one piece of ice, such that the amount of ice is less than the predetermined threshold may be less than one piece of ice, for example, no ice may be harvested. In some embodiments, the method 700 may further include a step of counting a number of harvest cycles of the plurality of harvest cycles. In such embodiments, the step 720 of determining the amount of ice harvested is less than the predetermined threshold may be based on the counted number of harvest cycles of the plurality of harvest cycles. For instance, when the counted number of harvest cycles may be higher, or larger, than a target number of harvest cycles, e.g., a number of harvest cycles that may be known to fill the ice storage bin, it may be determined that the amount of ice harvested is less than the predetermined threshold. Particularly, when the counted number of harvest cycles is higher than the target number of harvest cycles, it may be known that during the plurality of harvest cycles performed, little or no ice may have been harvested, e.g., the amount of ice harvested may have been less than the predetermined threshold, as the operation of the harvest mechanism was not suspended in response to it being sensed that the ice storage bin was filled.

Moreover, in some embodiments, the counted number of harvest cycles may be a counted number of harvest cycles after a last demand for ice. For instance, an input may be received that may be indicative of a last demand for ice, for example, may be indicative of a request to dispense ice stored within the ice storage bin or may be indicative of ice being removed from the ice storage bin. In some embodiments, the last demand for ice may be a last input received at a dispensing assembly, e.g., the dispensing assembly 140, such as a last input received at the dispensing assembly that request ice to be taken from the ice storage bin. For example, the last input received at the ice dispenser may be the actuation of an actuation mechanism, such as the actuation mechanism 148 of dispensing assembly 140, to dispense ice stored within the ice storage bin.

Alternatively, in some embodiments, the last demand for ice may be a last detected opening of a door of the ice maker appliance. For example, the last demand for ice may be the detected last opening of the door 128 of the ice maker appliance 100. When the door of the ice maker appliance is closed, no ice may be physically removed from the ice storage bin, for example, no ice may be taken from the ice storage bin by a user of the ice maker appliance. As such, the last detected opening of the door may indicate that ice may have been physically removed from the ice storage bin, for example, by a user of the ice maker appliance.

Accordingly, in embodiments where the counted number of cycles since the last demand for ice exceeds an expected amount, e.g., a predetermined threshold number of harvest cycles, it may thus be determined that the amount of ice harvested is less than the predetermined threshold. For example, in the absence of a demand for ice, e.g., when no ice is being removed from the ice storage bin, the number of harvest cycles to completely fill the bin may be the predetermined threshold number of harvest cycles. Thus, little or no ice may have been harvested, e.g., the amount of ice harvested may have been less than the predetermined threshold, as the operation of the harvest mechanism was not suspended in response to it being sensed that the ice storage bin was filled and the counted number of harvest cycles after the last demand for ice is a high enough number of harvest cycles that the storage bin would have been filled had the amount of ice harvested been equal to or greater than the predetermined ice harvest amount threshold.

Furthermore, in some embodiments, the step of counting the number of harvest cycles of the plurality of harvest cycles may be performed during a predetermined time period. In addition, in such embodiments, the step 720 of determining the amount of ice harvested is less than the predetermined threshold may further include a step of determining that the number of harvest cycles of the plurality of harvest cycles during the predetermined time period is greater than a predetermined harvest rate, e.g., a rate at which ice may be harvested from a mold body of the ice maker appliance. The predetermined harvest rate may be based on a time it takes a fill of ice to form within the mold body and the time it takes to eject the formed ice piece into the ice storage bin. When the counted number of harvest cycles of the plurality harvest cycles during the predetermined time period, e.g., the actual harvest rate, is greater than the predetermined harvest rate, it may be determined that the mold body is reaching an ice forming temperature faster than expected, such as when a thermal mass of liquid water in the mold body is less than a full fill of the mold body, such as no liquid water in the mold body. This may occur when no water may be present in the compartments of the mold body and the rate of temperature change increases as there is no water to remove additional energy from, or there is no water in the compartments of the mold body to freeze.

In some embodiments, the method 700 may further include a step of measuring, with a flow meter, for example, the flow meter 516, a flow rate of liquid water flowed to the mold body of the ice maker appliance during a fill cycle, e.g., a cycle wherein a fill of liquid water may flow into the compartments of the mold body. Further, the method 700 may also include a step of determining that the measured flow rate of the liquid water is less than a predetermined flow rate threshold. In some embodiments, the predetermined flow rate threshold may be a flow rate of 0.1 gallons per minute or less, such as a predetermined flow rate threshold of zero gallons per minute, or no flow of liquid water. Thus, in some embodiments, determining the amount of ice harvested is less than the predetermined threshold may be based on the measured flow rate of the liquid water being less than the predetermined flow rate threshold.

In some embodiments, the method 700 may further include a step of measuring, with a temperature sensor, for example, with the temperature sensor 350 of ice maker assembly 300, a mold body temperature of the mold body of the ice maker appliance. In such embodiments, determining the amount of ice harvested is less than the predetermined threshold may be based on a time for the mold body temperature to reach a harvest target temperature. For instance, in some embodiments, a heater, such as ice harvest heater 270 of ice maker assembly 180, may be engaged to the mold body to slightly melt the ice such that the ice may be released from the compartments of the mold body. The heater may raise the temperature of the mold body to a harvest target temperature, e.g., a known temperature that may slightly melt ice that may have formed within the compartments of the mold body.

Furthermore, the step of determining the amount of ice harvested is less than the predetermined threshold may be based on the time for the mold body temperature to reach the harvest target temperature may include a step of determining that the time for the mold body temperature to reach a harvest target temperature is less than a predetermined temperature change rate. When the time that it takes the mold body to reach the harvest temperature is less than, or shorter than, the predetermined temperature change rate, it may be determined that the amount of ice harvested is less than the predetermined threshold as it may be determined that no liquid water was present, and no ice was formed in the compartment of the mold body during the harvest cycle.

Method 700 may include a step 730 of suspending operation of the harvest mechanism based on it being determined that the amount of ice harvested is less than the predetermined threshold, for example, as determined in step 720. In some embodiments, the suspended operation of the harvest mechanism may save energy as dry cycling of the ice maker appliance may be stopped. In addition, when the operation of the ice maker appliance is suspended, a user of the ice maker appliance may be informed that the ice maker may be dry cycling. This may be beneficial as it may inform a user of the ice maker appliance that an issue may be present within the ice maker assembly, for example, an issue may be present within the water supply line such as water not flowing through the water supply line.

Embodiments of the ice maker appliances provided herein may advantageously improve the operation of the ice maker appliance as the operation of the harvest mechanism of the ice maker appliance may automatically be suspended, e.g., turned off, in the absence of water to the ice maker assembly. Moreover, the improved operation may advantageously save energy as the ice maker assembly may no longer waste energy due to unnecessary dry cycles. Furthermore, the improved operation of the ice maker appliance may advantageously alert a user of the ice maker appliance that a problem may be present within the water supply line.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A method for operating an ice maker appliance, the method comprising:

operating a harvest mechanism of an ice maker assembly to perform a harvest cycle, whereby an amount of ice is harvested from a mold body of the ice maker assembly due to the harvest cycle;

measuring, with a flow meter of the ice maker appliance, a flow rate of liquid water flowed to a mold body of the ice maker appliance during a fill cycle;

determining that the measured flow rate of the liquid water is less than a predetermined flow rate threshold;

determining the ice maker assembly is dry cycling, wherein determining the ice maker assembly is dry cycling comprises determining no ice was harvested from the mold body due to the harvest cycle, wherein determining no ice was harvested from the mold body due to the harvest cycle is based on determining that the measured flow rate of the liquid water is less than the predetermined flow rate threshold; and suspending operation of the harvest mechanism based on determining the ice maker assembly is dry cycling.

2. The method of claim 1, wherein the harvest cycle is one of a plurality of harvest cycles, further comprising counting a number of harvest cycles of the plurality of harvest cycles, and wherein determining no ice was harvested from the mold body due to the harvest cycle comprises determining the counted number of harvest cycles is higher than a target number of harvest cycles known to fill an ice storage bin.

3. The method of claim 2, wherein the number of harvest cycles are counted after a last demand for ice.

4. The method of claim 3, wherein the ice maker appliance comprises a dispensing assembly, further comprising receiving an input at the dispensing assembly, and wherein the last demand for ice is a last input received at the dispensing assembly.

5. The method of claim 3, wherein the ice maker appliance comprises a door and wherein the last demand for ice is a last detected opening of the door of the ice maker appliance.

6. The method of claim 2, wherein counting the number of harvest cycles of the plurality of harvest cycles is performed during a predetermined time period, and wherein determining no ice was harvested from the mold body due to the harvest cycle comprises determining that the number of harvest cycles of the plurality of harvest cycles during the predetermined time period is greater than a predetermined harvest rate at which ice is harvested from the mold body of the ice maker assembly.

7. The method of claim 1, further comprising measuring, with a temperature sensor, a mold body temperature of a mold body of the ice maker appliance, wherein determining no ice was harvested from the mold body due to the harvest cycle is based on a time for the mold body temperature to reach a harvest target temperature.

8. The method of claim 7, wherein determining no ice was harvested from the mold body due to the harvest cycle is based on the time for the mold body temperature to reach the harvest target temperature comprises determining that the time for the mold body temperature to reach a harvest target temperature is less than a predetermined temperature change rate.

9. An ice maker appliance comprising:

an ice maker assembly comprising a mold body for forming ice and a harvest mechanism for harvesting ice from the mold body;

a flow meter in fluid communication with the ice maker assembly; and a controller operably coupled to the ice maker assembly, the controller operable for:

operating the harvest mechanism of the ice maker assembly to perform a harvest cycle, whereby an amount of ice is harvested from the ice maker assembly due to the harvest cycle;

measuring, with the flow meter, a flow rate of liquid water flowed to a mold body of the ice maker appliance during a fill cycle;

determining that the measured flow rate of the liquid water is less than a predetermined flow rate threshold;

determining the ice maker assembly is dry cycling, wherein determining the ice maker assembly is dry cycling comprises determining no ice was harvested from the mold body due to the harvest cycle, wherein determining no ice was harvested from the mold body due to the harvest cycle is based on determining that the measured flow rate of the liquid water is less than the predetermined flow rate threshold; and suspending operation of the harvest mechanism based on determining the ice maker assembly is dry cycling.

10. The ice maker appliance of claim 9, wherein the harvest cycle is one of a plurality of harvest cycles, further comprising counting a number of harvest cycles of the plurality of harvest cycles, and wherein determining no ice was harvested from the mold body due to the harvest cycle comprises determining the counted number of harvest cycles is higher than a target number of harvest cycles known to fill an ice storage bin.

11. The ice maker appliance of claim 10, wherein the number of harvest cycles are counted after a last demand for ice.

12. The ice maker appliance of claim 11, further comprising a dispensing assembly, wherein the controller is further operable for receiving an input at the dispensing assembly, and wherein the last demand for ice is a last input received at the dispensing assembly.

13. The ice maker appliance of claim 11, wherein the ice maker appliance comprises a door and wherein the last demand for ice is a last detected opening of the door of the ice maker appliance.

14. The ice maker appliance of claim 10, wherein counting the number of harvest cycles of the plurality of harvest cycles is performed during a predetermined time period, and wherein determining no ice was harvested from the mold body due to the harvest cycle comprises determining that the number of harvest cycles of the plurality of harvest cycles during the predetermined time period is greater than a predetermined harvest rate at which ice is harvested from the mold body of the ice maker assembly.

15. The ice maker appliance of claim 9, wherein the controller is further operable for measuring, with a temperature sensor, a mold body temperature of a mold body of the ice maker appliance, wherein determining no ice was harvested from the mold body due to the harvest cycle is based on a time for the mold body temperature to reach a harvest target temperature.

16. The ice maker appliance of claim 15, wherein determining no ice was harvested from the mold body due to the harvest cycle is based on the time for the mold body temperature to reach the harvest target temperature comprises determining that the time for the mold body temperature to reach a harvest target temperature is less than a predetermined temperature change rate.

* * * * *